United States Patent [19]

Saito et al.

[11] 4,203,478

[45] May 20, 1980

[54] AUTOMATIC SHUT OFF DISPENSING NOZZLE

[75] Inventors: Yoshio Saito, Urawa; Yoshio Shibata, Yokohama; Satosi Fujiie, Kawasaki, all of Japan

[73] Assignee: Tokico, Ltd, Kawasaki, Japan

[21] Appl. No.: 934,601

[22] Filed: Aug. 17, 1978

[30] Foreign Application Priority Data

Aug. 20, 1977 [JP] Japan ..... 52-099947

[51] Int. Cl.[2] ..... B65B 3/26

[52] U.S. Cl. ..... 141/206; 141/302

[58] Field of Search ..... 141/39–42, 141/46, 59, 52, 97, 94, 198–229, 392, 301, 302

[56] References Cited

U.S. PATENT DOCUMENTS 3,823,752 7/1974 Lasater et al. ..... 141/225

4,131,140 12/1978 Deters ..... 141/225

*Primary Examiner*—Houston S. Bell

*Attorney, Agent, or Firm*—Stevens, Davis, Miller & Mosher

[57] ABSTRACT

An automatic shut off dispensing nozzle has a nozzle main body, a discharge pipe disposed down stream of the main body, a fluid passage provided substantially straight in the main body, a valve mechanism having an axial line crossing the fluid passage, a lever provided to the main body for the operation of the valve mechanism, a first sliding shaft interlocking with the lever and having the same axial line as that of the valve mechanism, a second sliding shaft provided on the same axial line of the first sliding shaft for the operation of the valve mechanism, rollers provided for causing engagement between each of the sliding shafts, a diaphragm for the retention of the rollers, a negative pressure chamber including the diaphragm, an apparatus for generating a negative pressure which is communicated to the negative pressure chamber, and an atmosphere introducing port provided in the discharge pipe which communicates with the negative pressure chamber.

8 Claims, 13 Drawing Figures

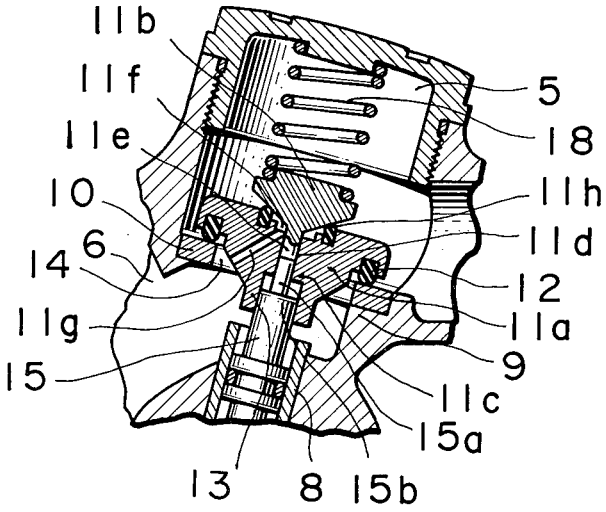
FIG. 9
FIG. 11
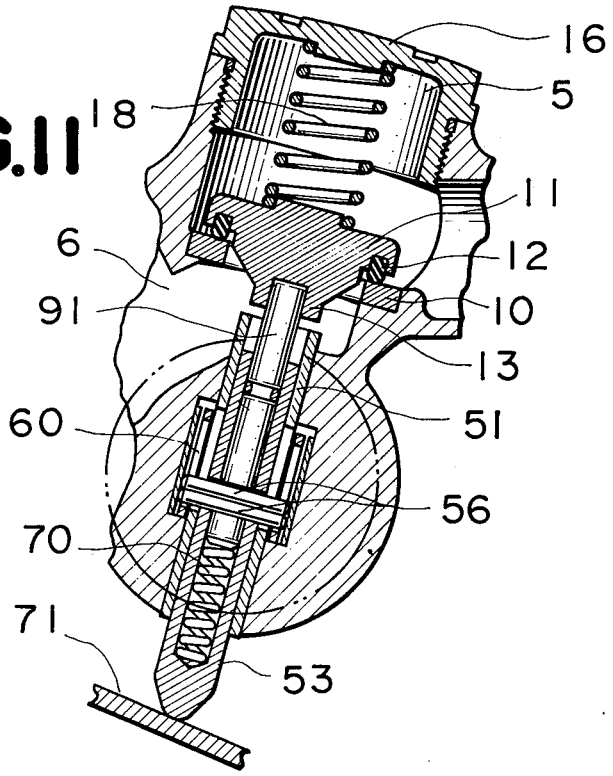

AUTOMATIC SHUT OFF DISPENSING NOZZLE

DETAILED DESCRIPTION OF THE INVENTION

This invention relates to an automatic shut off dispensing nozzle to be used for supplying fuel oil to the tanks of automobiles or the likes.

An automatic shut off dispensing nozzle is generally designed such that when an opening provided to an discharge pipe for communication with atmosphere is closed, a negative pressure is generated in a negative pressure chamber to actuate a valve mechanism provided in a fluid passage thereby automatically causing the fluid passage to be closed. In conventional automatic shut off dispensing nozzles, for example, as disclosed in U.S. Pat. No. 3,062,247, an axis for a main valve and an axis for leading to a negative chamber are provided independently from each other in a nozzle body. But such an automatic shut off dispensing nozzle has drawbacks in that the structure is complicated and it requires an increased number of parts. Another type of automatic shut off dispensing nozzle, for example, as disclosed in U.S. Pat. No. 3,638,689 is also known in which the axis for the main valve and the axis for leading to the negative chamber are provided coaxially in the fluid passage. The automatic shut off dispensing nozzle in the above U.S. Pat. No. 3,638,689 also has defects in that the oil dispensing hose connected to the automatic dispensing nozzle by means of a coupling has to be removed for the maintenance and inspection of the valve mechanism and the automatic shut off valve mechanism since the valve mechanism is mounted together with the automatic shut off valve mechanism in the fluid passage. Also the pressure loss is increased to which restricts the amount of fluid discharged from the nozzle since the valve mechanism and the automatic shut off valve mechanism are provided along the fluid passage.

Moreover, conventional automatic shut off dispensing nozzles have been adapted such that a first shaft and a sleeve or a second shaft for the operation of the valve mechanism are engaged by way of rollers and the coupling between the above first shaft and the sleeve or the second shaft by the rollers are disengaged when an atmosphere introducing opening is closed by oil liquid.

In such a conventional automatic shut off dispensing nozzle, however, re-starting of the oil supply is impossible unless the atmosphere introducing opening is raised above the oil surface and the first shaft and the sleeve or the second shaft are engaged by causing the rollers to be present again between the shaft and the sleeve or both of the shafts. Consequently, when oil is supplied using a conventional automatic shut off dispensing nozzle, a vehicle tank may some time not be filled to a desired full level even when the fluid supply is automatically tripped depending upon the length of the discharge pipe or the like, and the oil supply has to be restarted in order to substantially fill the tank after pulling out the automatic shut off dispensing nozzle once to expose the atmosphere introducing port to the atmosphere, which lessens to a large extent the practicality of the system.

An object of this invention is to provide an automatic shut off dispensing nozzle simple in structure and with less parts.

Another object of this invention is to provide an automatic shut off dispensing nozzle which is easy to maintain and inspect, and which enables the separate maintenance and inspection of the valve mechanism and the automatic shut off valve mechanism.

A further object of this invention is to provide an automatic shut off dispensing nozzle capable of reducing pressure loss due to the valve mechanism to thereby increase the discharge amount.

A still further object of this invention is to provide an automatic shut off dispensing nozzle capable of supplying oil continuously without exposing the atmosphere introducing port to the atmosphere thereby communicating the negative chamber to the atmosphere even after the closure of the atmosphere introducing port by the liquid oil and the automatic closure of the valve by the negative pressure of the negative chamber.

The foregoing objects and features of this invention, together with its other object and features, will be made clearer by the following preferred embodiments to be described referring to the drawings.

FIG. 9 to FIG. 13 are explanatory views showing main parts of other preferred embodiments of the automatic shut off dispensing nozzle according to this invention.

Figure 1:
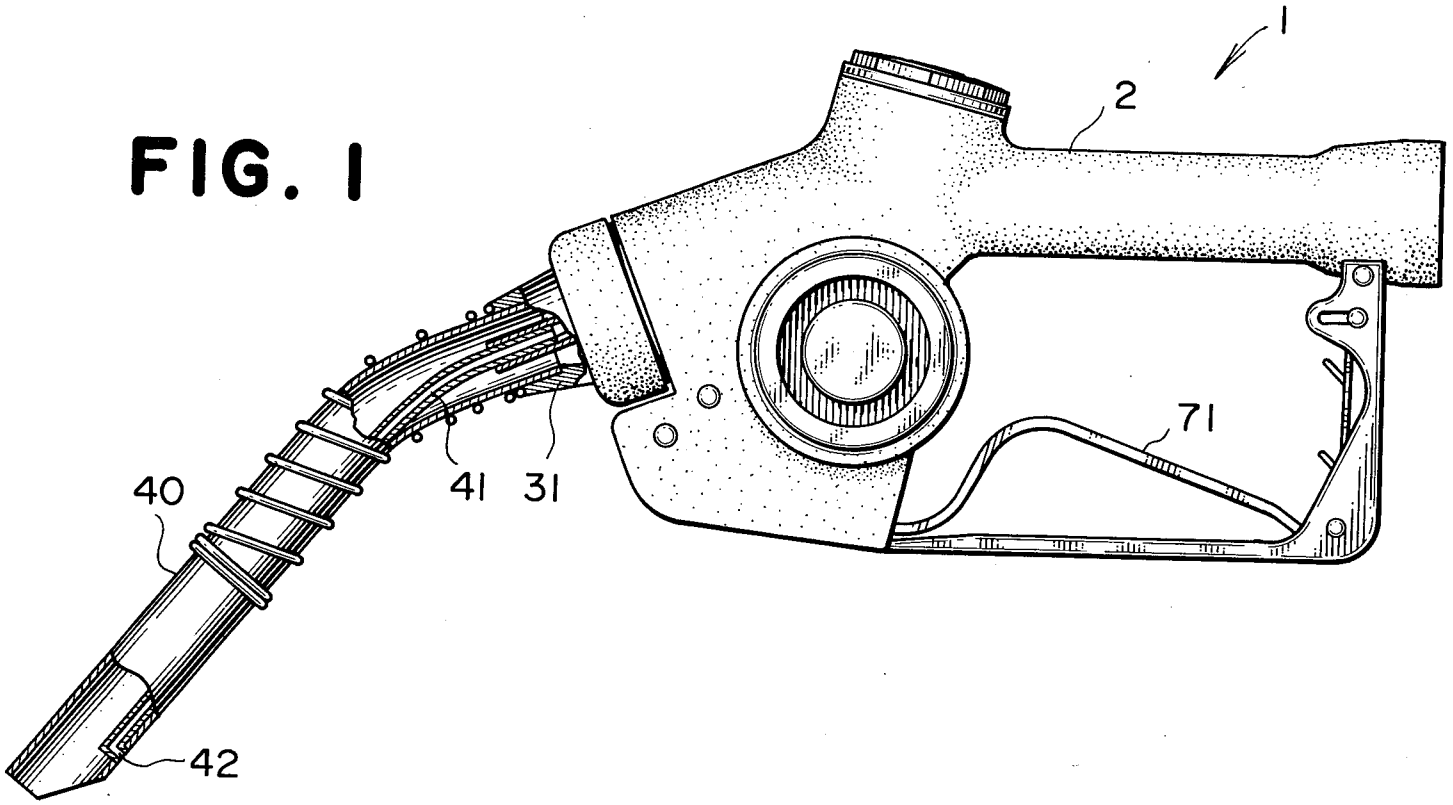
FIG. 1 shows a preferred embodiment of an automatic shut off dispensing nozzle according to this invention.
Figure 2:
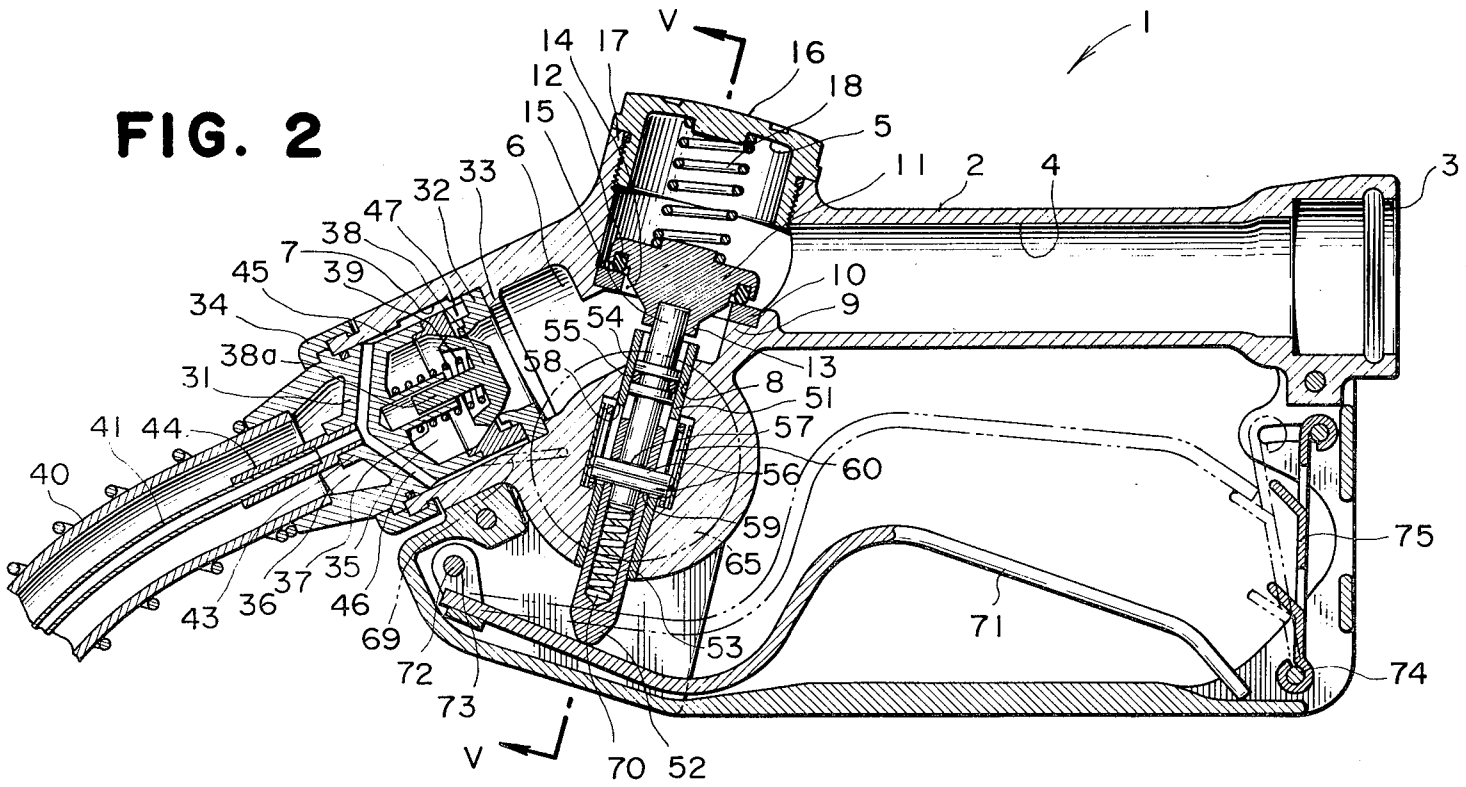
FIG. 2 shows a partially enlarged vertical cross section for the embodiment shown in FIG. 1.
Figure 3:
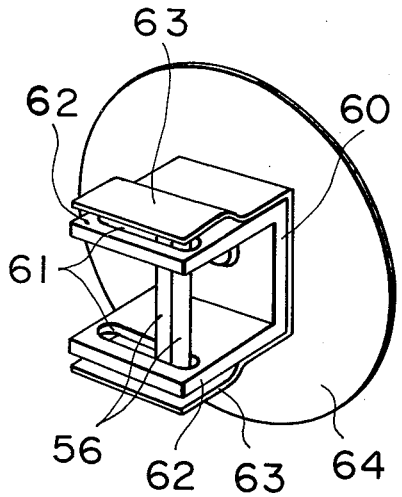
FIG. 3 is a detailed perspectional view for a support member shown in FIG. 2.
Figure 4:
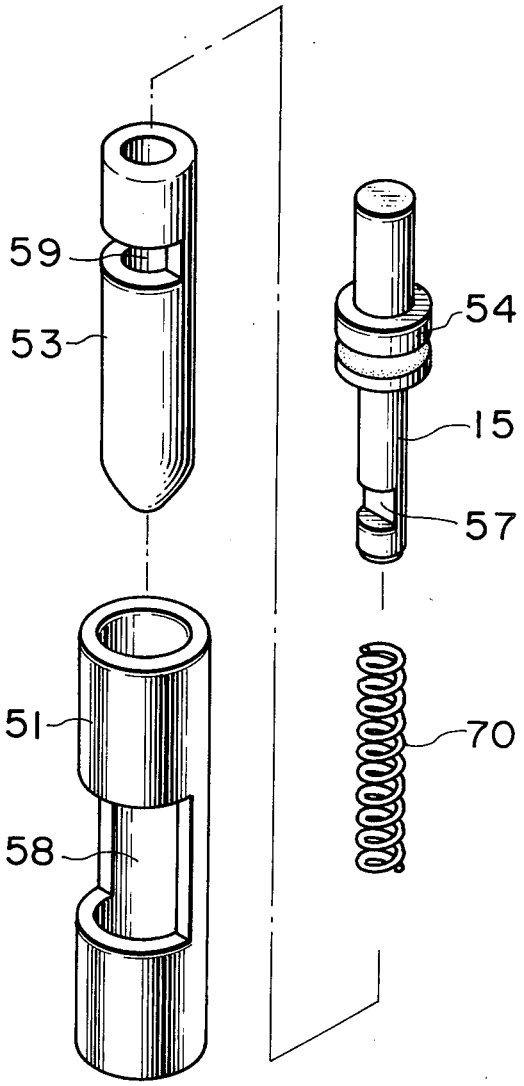
FIG. 4 is an explosive view for a shaft and the like shown in FIG. 2.

In FIG. 1 through FIG. 8, a main body 2 of a nozzle 1 has provided therein a cylindrical fluid passage 4 communicating with an inlet 3, a first valve chamber 5 communicating with the fluid passage 4, a second valve chamber 7 communicatable with the valve chamber 5 by way of a chamber 6 and a through hole 8 extending from the chamber 6 to the outside of the main body 2. The inlet 3 is fitted with an adequate conduit, such as an oil dispensing hose and the like through which fluid such as oil is supplied to the fluid passage 4 and the first valve chamber 5. At the bottom surface of the cylindrical valve chamber 5, is provided an annular shoulder 9 which projects inwardly from the main body 2 and an annular valve seat 10 is secured to this shoulder 9. A valve mechanism, that is, a main valve 11 disposed in the first valve chamber 5 is mounted on the valve seat 10 in such a way that its axial line crosses the fluid passage which is formed substantially straight, and the valve 11 is attached at its lower surface with a seal ring 12. A cylindrical sleeve-like projection 13 projecting downwardly from about the center of the bottom surface of the valve 11 is disposed within a center aperture 14 of the valve seat 10 with a gap therebetween. A shaft 15 is inserted at its one end into the projection 13 of the valve 11. A plug 16 is fittedly or threadingly engaged to a cylindrical wall 17 of the main body 2 that is formed substantially perpendicular to the fluid passage so as to close the upper surface of the first valve chamber 5. A spring 18 is mounted between the plug 16 and the valve 11 and it resiliently urges the seal ring 12 provided to the valve 11 downwardly to the upper surface of the valve seat 10.

A generally cylindrical valve holder 31 and a valve seat 32 are mounted in the second valve chamber 7. The valve seat 32 is disposed between an annular shoulder 33 of the main body 2 and the valve holder 31, and the valve holder 31 is engaged to the main body 2 by a cylindrical engaging member 34 fittedly or threading engaged to the top end of the main body 2. The inside of the valve holder 31 is substantially hollow and annular cavities 35 and 36 therein are communicated with each other. A valve rod 38*a* which extends from about the center of an auxiliary valve 38 is slidably inserted into a cylindrical portion 37 intengrally projected from about the center of the holder 31 into the cavity 35, and a spring 39 is mounted between the valve 38 and the valve holder 31 so as to resiliently urge the valve 38 to the valve seat 32. A discharge pipe 40 fitted to the top end of the holder 31 has in its inside a pipe 41 of a smaller diameter which extends to the opening 42 provided to the pipe 40, and the pipe 41 is held to the holder 31 by being fitted at its the other end into a sleeve 44 fitted in the cylindrical projection 43 of the holder 31. An annular gap 45 is formed between the main body 2 and the holder 31 and the valve seat 32, and a communication aperture 46 is formed through the holder 31 so as to communicate the gap 45 and the inside of the pipe 41. An orifice 47 is further formed through the valve seat 32 so as to communicate the gap 45 and the space in which the valve 38 is situated, that is, the fluid passage.

To the inside of a sleeve 51 of a circular cross section provided to the through hole 8 which crosses substantially perpendicular to the fluid passage 4, are slidably inserted coaxially a shaft 15 and a cylindrical shaft 53 closed at its one end 52. These shafts 15 and 53 are disposed along the same axial line as that of the valve mechanism. The shaft 15 has formed about the middle thereof a flange 54 to which a seal ring 55 is fitted. One end of the shaft 15 is slidably inserted into the inside of the shaft 53 and is formed with a groove 57 for receiving two rollers 56. The sleeve 51 and the shaft 53 have rectangular openings 58 and 59 respectively corresponding to the position of the groove 57. Each end of the rollers 56 is inserted into the elongated holes 61 perforated in a roller support member 60 and the rollers 56 can thereby be moved along this elongated apertures 61 under rotation. Guide plates 63 are secured with side plates 62 of the roller support member 60 for anti-slip off of the rollers 56. The roller support 60 is supported by way of a diaphragm 64 secured thereto movably transversely to the main body 2 and biased transversely by a spring 67 mounted between a plug 65 and a receptor 66 secured to the roller support 60 so as to connect the shafts 15 and 53. The plug 65 is fittedly or threadingly provided to the main body 2, and the space, that is, a chamber 68 defined by the plug 65 and the diaphragm 64 communicates by way of a communication pass 69 provided to the main body 2 to the gap 45. A spring 70 inserted inside of the shaft 53 acts so that it moves the shaft 53 downwardly to abut its end 52 to a manipulation lever 71. The manipulation lever 71 is connected to a link 73 pivoted by a pin 72 to the main body 2, and the manual operation to left manipulation lever 71 to upwards operates the shaft 53 and the like. A latch member 75 pivoted by a pin 74 to the rear end of the main body 2 engages the free end of the manipulation lever 71 to hold the lever 71 in its desired operation position.

Figure 5:
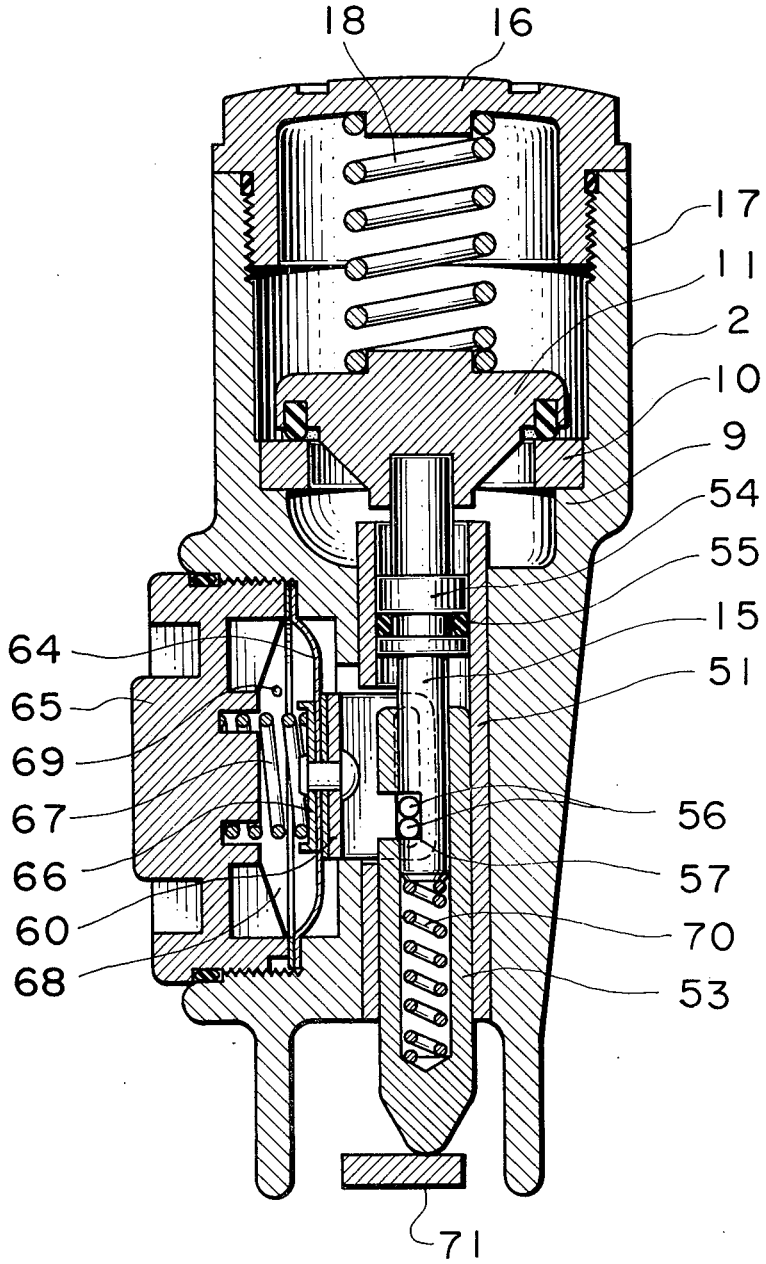
FIG. 5 is an end view of the embodiment shown in FIG. 2 taken along line V—V.
Figure 6:
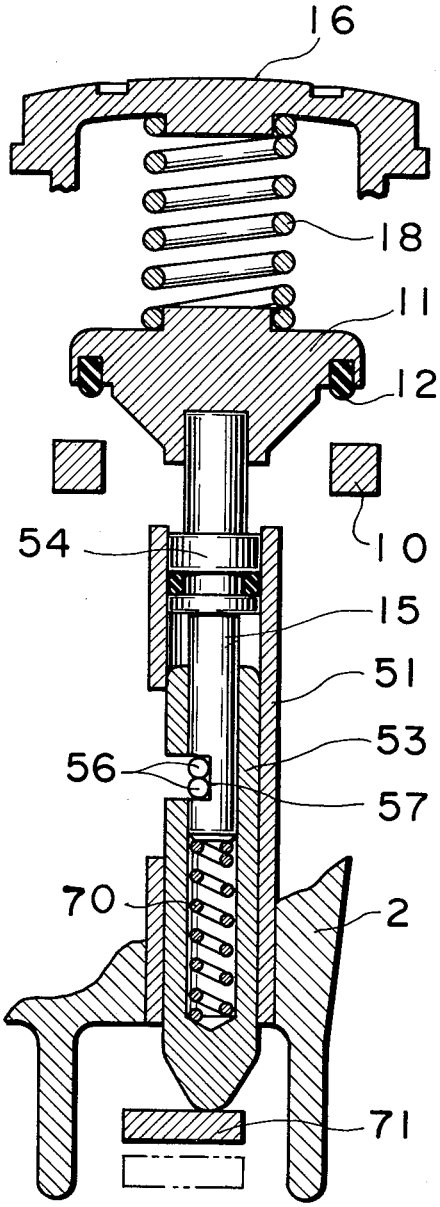
FIG. 6 is an explanatory view for the operation of an automatic shut off valve mechanism shown in FIG. 2.
Figure 7:
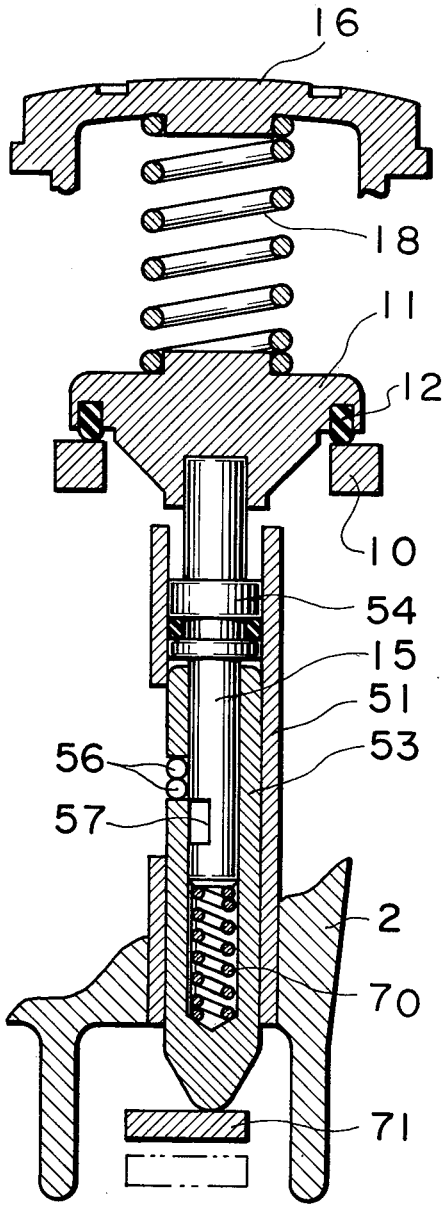
FIG. 7 is an explanatory view for the operation of a first and a second shafts where their engagement by the rollers is released in the operation of the embodiment shown in FIG. 2.
Figure 8:
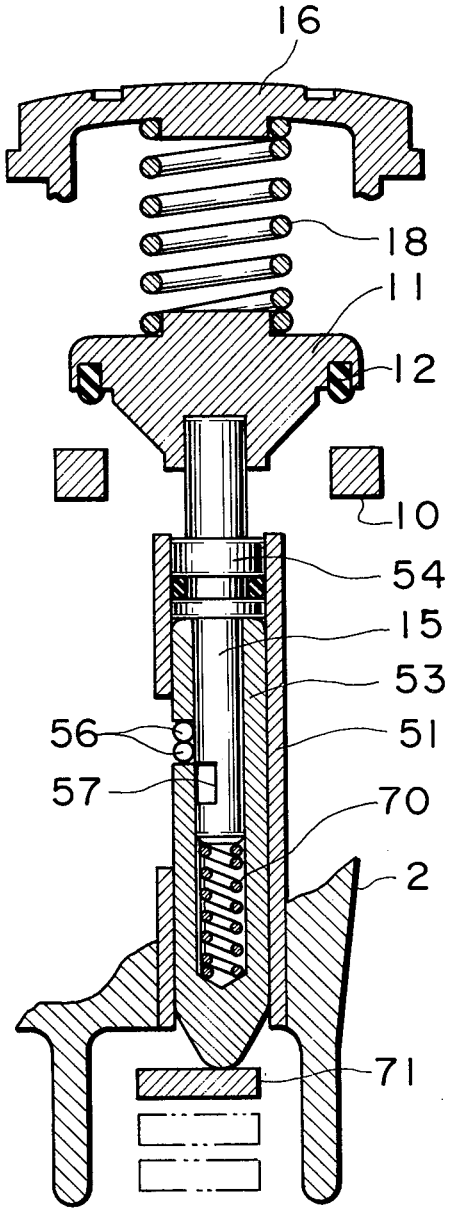
FIG. 8 is an explanatory view for the re-operation of a valve by the manipulation of a lever.

Referring to the operation of the above automatic shut off dispensing nozzle, fluid supplied through the conduit connected to the inlet 3 fills the fluid passage 4 and the first valve chamber 5 in a state where the manipulation lever 71 of the nozzle 1 is not yet operated and the nozzle 1 is in the state as shown in FIG. 1 (and FIG. 5). Since the seal ring 12 is urged to the upper surface of the valve seat 10 by the expansive force of the spring 17, the first valve chamber 5 and the chamber 6 are not communicated and, therefore, the fluid within the chamber 5 is not supplied to the chamber 6. Then, upon turning the manipulation lever 71 manually, the shaft 53 whose one end 52 abuts against the manipulation lever 71 moves upward. On one hand, since the pressure in the chamber 68 does not reduce to a predetermined negative pressure (reduced pressure) unless fluid flow is generated at the opening end of the orifice 47 to the fluid passage and the opening 42 is closed, the support member 60 is laterally displaced under expansive force of the spring 67 to enforce the rollers 56 into the groove 57. The shaft 15 and the shaft 53 are thus engaged to each other by way of the rollers 56 and, accordingly, the shaft 15 moves upward accompanying with the upward movement of the shaft 53. When the shaft 15 is thus moved upwardly, the valve 11 is also moved upwardly to release the abutment of the seal ring 12 of the valve 11 against the valve seat 10, whereby the fluid supplied in the chamber 5 is now supplied by way of the gap between the lower surface of the valve 11 and the valve seat 10 into the chamber 6. By holding the manipulation lever 71 on the latch 75 in this state, the fluid in the chamber 5 supplied from the conduit continuously flows into the chamber 6. When the force exerted by the fluid flowing into the chamber 6 upon the valve 38 overcomes the expansive force of the spring 39, the abutment between the valve 38 and the valve seat 32 is disengaged and the fluid in the chamber 6 is led to the discharge pipe 40 by way of the cavity portions 35 and 36. The fluid supplied to the inlet 3 is thus supplied by way of the discharge pipe 40 to the tank of a vehicle or the like.

When the fluid is successively supplied in the tank and the liquid surface comes above the opening 42, communication between the inside of the pipe 41 and the atmosphere is disconnected. If the fluid is further supplied in such a state to the tank, the pressures in the orifice 47, the annular gap 45 and the aperture 46 become reduced due to a Venturi effect, since one end of the orifice 47 opens to the flow passage of the fluid. When the pressure in the annular gap 45 is reduced, the pressure in the chamber 68 communicating therewith is also reduced thereby displacing the diaphragm 64 and hence the support member 60 toward the plug 65.

When the roller support 60 is displaced toward the plug 65, the rollers 65 come out of the groove 57 to disengage the shaft 15 and the shaft 53 whereby the valve 11 and the shaft 15 are moved downwardly by the expansive force of the spring 18 causing the seal ring 12 of the valve 11 to abut against the valve seat 10 and, as the result, flow of the fluid from the chamber 5 to the chamber 6 is inhibited. In this embodiment, the expansive force of the spring 18 is made greater than that of the spring 70 so as to attain the above state. When the fluid supplied from the inlet 3 is no longer introduced to the chamber 6, fluid is not discharged from the top end of the discharge pipe 40, and the valve 38 is actuated by the expansive force of the spring 38*a* to abut against the valve seat 32 thereby disconnecting the communication between the chamber 6 and the cavity 35. While the tank of a vehicle can thus be filled, a further supply of fluid can be made by the following manner if the tank has not yet been filled to a desired full level. The manipulation lever 7 is further pulled up while leaving the discharge pipe 40 immersed in the tank. Upon the further raising of the manipulation lever 71, the shaft 53 is moved upward and its upper end abuts against the annular shoulder 54 of the shaft 15 to thereby raise the shaft 15 together with the shaft 53. The rise of the shaft 15 again causes the valve 11 to move upwardly again against the expansive force of the spring 18 as earlier described and the chamber 5 and the chamber 6 again communicate. When the communication between the chamber 5 and the chamber 6 is attained, the fluid is again discharged from the discharge pipe 40 and supplied to the tank. When the tank is filled to a desired full level and the lever 71 is lowered to the initial position, the shaft 53 is urged downwardly by the expansive force of the spring 70 and, at the same time, the shaft 15 is also moved downwardly by the spring 18 whereby the communication between the chamber 5 and the chamber 6 is inhibited. Thereafter, when the discharge pipe 40 is pulled up out of the liquid in the tank, the inside of the pipe 41 is exposed to atmosphere by way of the opening 42 and the reduced pressure in the chamber 68 is therefore released, and the diaphragm 64 and the support member 60 are moved to their initial positions by the expansive force of the spring 67. When the roller support 60 has thus been set to the initial position, the rollers 56 are also placed in the groove 57, by which the connection is again attained between the shaft 15 and the shaft 53.

In another embodiment of this invention, the valve mechanism may be constituted as in FIG. 9. The valve mechanism shown in FIG. 9 comprises a main valve 11*a* and an auxiliary valve 11*b* having the same axis as that of the valve 11*a* and provided upstream of the valve 11*a*. About at the center of the valve 11*a*, is formed a through hole 11*d* having an annular shoulder 11*c* at the its periphery and a valve rod 11*e* projected from the center of the valve 11*b* and one end of the shaft 15 are slidably inserted into the above through hole 11*d*. A recess 11*f* is formed about at the center of the top surface of the valve 11*a* and a communication aperture 11*g* is perforated through the valve 11*a* so as to communicate the recess 11*f* with the central aperture 14 of the valve seat 10 situated down stream thereof. A seal ring 11*h* is secured to the valve 11*a* at the outer side of the recess 11*h* on the top surface of the valve 11*a*. The upper end of the shaft 15 is integrally upwardly extended into a rod 15*a* of a reduced diameter while leaving a shoulder 15*b* therearound and the top of the rod 15*a* abuts against the valve rod 11*e*.

In the valve mechanism constituted as above, since the top end of the shaft 15 abuts against the valve rod 11*e*, the valve 11*b* is at first moved upwardly against the expansive force of the spring 18 by the upward displacement of the shaft 15 to communicate the chamber 5 with the recess 11*f*. Fluid supplied to the chamber 5 is thus introduced through the recess 11*f* and the aperture 11*g* into the chamber 6. Then, when the shaft 15 is further moved upwardly by the rotation of the lever 71 and abuts against the shoulder 11*c* of the valve 11*a*, the valve 11*a* is also moved upwardly together with the displacement of the shaft 15. This causes the fluid supplied in the chamber 5 to be introduced into the chamber 6 through the gap between the lower surface of the valve 11*a* and the valve seat 10. Since the pilot valve 11*b* having a smaller pressure-receiving area from the liquid is actuated at first and then the main valve 11*a* is operated in the valve mechanism of this embodiment, the operation force required for the manipulation lever 71 is not so great and the lever 71 can be rotated with extreme ease.

Reference is to be made to other embodiments of this invention based on FIG. 10 through FIG. 13.

Figure 10:
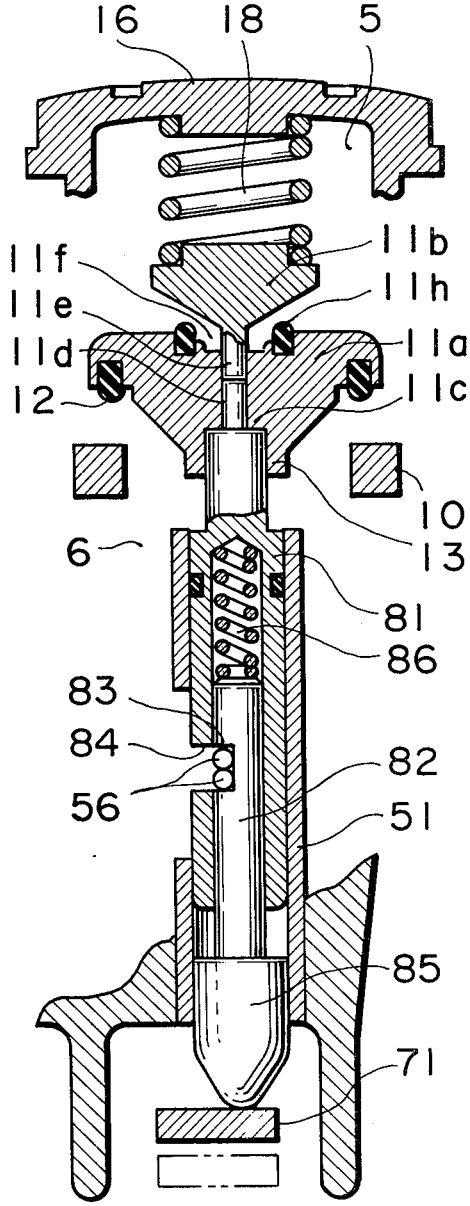

In FIG. 10, a shaft 81 is in a cylindrical form and receives in its hollow inside one end of a shaft 82. The shaft 82 is formed with a groove 83 for receiving rollers 56 and the shaft 81 is formed with a rectangular opening 84 corresponding to the position of the groove 83. The shaft 82 has at its lower end an annular shoulder 85 having an outer diameter substantially the same as the inner diameter of a sleeve 51. A spring 86 is mounted between the shaft 81 and the shaft 82 and the lower end of the shaft 82 is always urged to the manipulation lever 71 by the expansive force of the spring 86. In the dispensing nozzle having the shafts 81 and 82 constituted as above, where the rollers 56 are received in the groove 83, the upward movement of the manipulation lever 71 causes both of the shafts 81 and 82 to move upwardly which raises the valve 11*a* and the valve 11*b* upwardly against the expansive force of the spring 18. While on the other hand, where the pressure in the chamber 68 is reduced and the rollers come out of the groove 83, the shaft 81 and 82 are disengaged from each other. Then, the shaft 81 moves downwardly together with the rollers 56, whereby the valve 11*a* and the valve 11*b* are moved downwardly to inhibit the communication between the chambers 5 and 6. By raising the manipulation lever 71 in this state, however, the shaft 82 is further moved upwardly and abuts by its shoulder 85 against the lower end of the shaft 81 to raise the shaft 81 together with the movement of the shaft 82, whereby the valve 11*a* and the valve 11*b* are operated to attain the communication between the chambers 5 and 6.

In a further embodiment shown in FIG. 11, the diameter of a shaft 91 is formed substantially uniformly over its length and the re-operation of the valve 11 is performed by the abutment of the upper end of the shaft 53 against the annular projection 13 of the valve 11.

Figure 12:
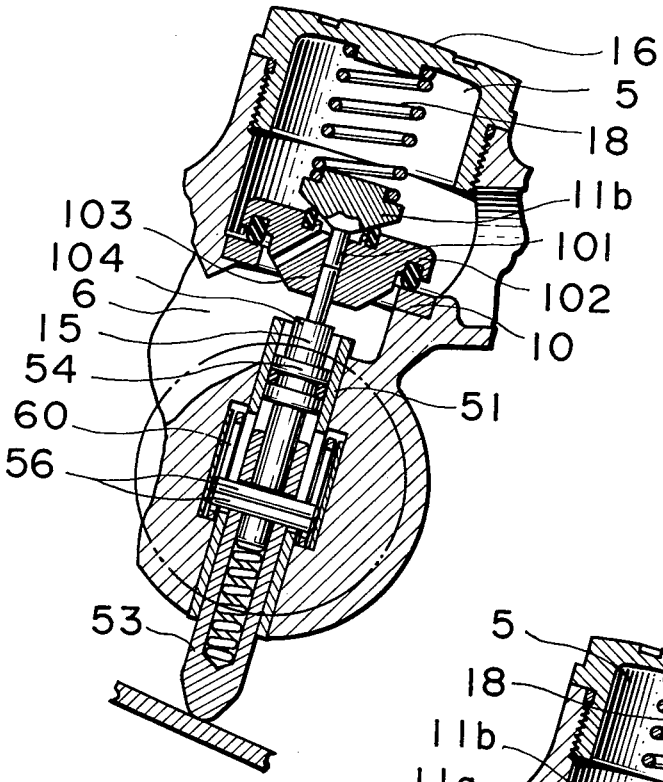

In a further embodiment shown in FIG. 12, a valve 102 is formed with a through hole 101 having a uniform diameter from its one opening to the other opening without having the shoulder denoted by the reference numeral 11*c* in FIG. 9, and the valve 102 is adapted to be operated by the abutment of an annular shoulder 104 of the shaft 15 against the lower surface of an annular projection 103 of the valve 102 for the re-operation of the valve 102 and 11*b*.

Figure 13:
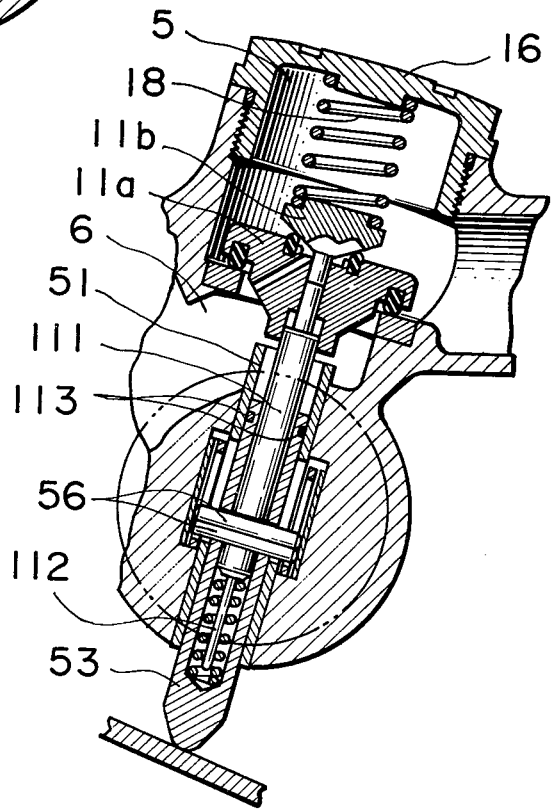

In a still further embodiment shown in FIG. 13, the re-operation of the valve 11*a* and 11*b* can also be performed by the provision of a shaft 111 having at its lower end a rod 112 which further extends downwardly therefrom and by abutting the shaft 53 against the lower end of the rod 112. A seal ring 113 is laid between the shaft 53 and the sleeve 51.

While the orifice 47 whose one end opens to the fluid passage is provided to the valve seat 32 in the foregoing embodiments, this invention is not always restricted to such arrangement, but the orifice may be disposed in any positions, for example, to the valve seat 10 so long as it can provide the Venturi effect.

What is claimed is:

1. An automatic shut off dispensing nozzle comprising:

(a) a nozzle main body having therein a substantially straight fluid passage;

(b) a discharge pipe disposed downstream of said fluid passage;

(c) a valve mechanism comprising a main valve lying on a valve seat in said fluid passage for opening and closing said fluid passage and having an auxiliary passage therein which connects the upstream side with the downstream side of said fluid passage, an auxiliary valve for opening and closing said auxiliary passage, both valves having the same axial line crossing said fluid passage, and a means for biasing said main and auxiliary valves to a normally closed condition;

(d) a lever provided on said main body for operating said valve mechanism;

(e) a first sliding shaft engaged with said lever and axially aligned with said valve mechanism;

(f) a second sliding shaft slidably fitted in said main body and axially aligned with said first sliding shaft for operating said valve mechanism;

(g) a first shoulder formed on at least one of said second sliding shaft and said main valve;

(h) a roller means providing engagement between said sliding shafts;

(i) a diaphragm for normally retaining said roller means in a position where said sliding shafts are engaged by said roller means;

(j) a negative pressure chamber including said diaphragm;

(k) means for supplying a negative pressure to said negative pressure chamber;

(l) a port provided on said discharge pipe and a conduit for introducing atmospheric pressure from said port to said negative pressure chamber to keep said diaphragm in a position where said sliding shafts are normally engaged by said roller means (m) said second sliding shaft being responsive to movement of said first sliding shaft by said lever to first open said auxiliary valve and thereafter abut said main valve via said first shoulder to open said main valve, said negative pressure being supplied to said negative pressure chamber when said atmosphere introducing port is closed by fluid to displace said diaphragm and disengage said first and the second sliding shafts engaged by said roller means to automatically close said main and auxiliary valves by said means for biasing.

2. The automatic shut off dispensing nozzle as claimed in claim 1, wherein said first shoulder is provided on said second sliding shaft.

3. The automatic shut off dispensing nozzle as claimed in claim 1, wherein said first shoulder is provided on both said second sliding shaft and said main valve.

4. The automatic shut off dispensing nozzle as claimed in claim 1, wherein said main body has a cylindrical portion substantially perpendicular to said fluid passage and said valve mechanism is provided in said cylindrical portion.

5. The automatic shut off dispensing nozzle as claimed in claim 1, wherein said lever has a first end pivoted to said main body and a second free end engaged by a latch member, said first sliding shaft being abutted to said lever between said pivoted and free ends.

6. The automatic shut off dispensing nozzle as claimed in any one of the claims 1 to 5, further comprising a second shoulder provided on at least one of said first and second sliding shafts for engaging said shafts together after the pressure in the negative chamber is reduced by the fluid blocking of said port and the engagement between said sliding shafts is released by the operation of said roller means, thereby enabling the opening of said valve mechanism by the manipulation of said lever.

7. The automatic shut off dispensing nozzle as claimed in any one of the claims 1 to 5, further comprising a rod extending downwardly from a lower end of said second sliding shaft so that both of said sliding shafts are engaged to each other by way of the said rod even after the release of an engagement of said sliding shafts by operation of said roller means when the pressure in the negative chamber is reduced, thereby enabling the opening of said valve mechanism by the manipulation of said lever.

8. The automatic shut off dispensing nozzle as claimed in any one of the claims 1 to 5, wherein said second sliding shaft has a substantially uniform diameter over its length and is inserted into said first sliding shaft so that said first sliding shaft abuts at an upper end thereof with said valve mechanism even after the engagement of said sliding shafts is released by the operation of said roller means when the pressure in said negative chamber is reduced, thereby enabling the opening of said valve mechanism by the manipulation of said lever.

* * * * *